US008793921B1

(12) United States Patent
Tonello et al.

(10) Patent No.: US 8,793,921 B1
(45) Date of Patent: Aug. 5, 2014

(54) TANGENT INTEGRATED TILT SIGHT

(71) Applicants: Brian Tonello, Halifax, MA (US); Brian Fraser-Swan, E. Bridgewater, MA (US); Richard Swan, E. Bridgewater, MA (US)

(72) Inventors: Brian Tonello, Halifax, MA (US); Brian Fraser-Swan, E. Bridgewater, MA (US); Richard Swan, E. Bridgewater, MA (US)

( * ) Notice: Subject to any disclaimer, the term of this patent is extended or adjusted under 35 U.S.C. 154(b) by 0 days.

(21) Appl. No.: 13/875,830

(22) Filed: May 2, 2013

(51) Int. Cl.
*F41G 11/00* (2006.01)

(52) U.S. Cl.
CPC ..... *F41G 11/004* (2013.01); *F41G 11/005* (2013.01)
USPC ..... 42/125

(58) Field of Classification Search
CPC ... F41G 11/001; F41G 11/003; F41G 11/004; F41G 11/005; F41G 11/007; F41G 11/008
USPC ..... 42/124, 125, 126, 127, 128
See application file for complete search history.

(56) References Cited

U.S. PATENT DOCUMENTS

| | | | | |
|---|---|---|---|---|
| 2,385,176 | A * | 9/1945 | White | 42/128 |
| 2,529,801 | A * | 11/1950 | Fisk | 42/128 |
| 7,367,152 | B2 | 5/2008 | Samson | |
| 7,908,782 | B1 | 3/2011 | LaRue | |
| 2013/0160345 | A1 * | 6/2013 | Li et al. | 42/124 |

* cited by examiner

*Primary Examiner* — Stephen M Johnson
(74) *Attorney, Agent, or Firm* — Lambert & Associates; Gary E. Lambert; David J. Connaughton, Jr.

(57) ABSTRACT

A pivoting mount for a firearm used to attach a firearm accessory is provided. The pivot mount has a base configured to attach to the firearm, and a top pivotally connected to the base. The top of the pivoting mount is pivotable between an engaged and disengaged position.

15 Claims, 22 Drawing Sheets

TANGENT INTEGRATED TILT SIGHT

BACKGROUND OF THE INVENTION

1. Field of the Invention

The present invention relates generally to firearm mounts. More particularly, the present invention relates to a pivoting firearm mount formed as a tangent integrated tilt sight.

2. Description of Related Art

Virtually all firearms are provided with mechanical sighting devices, many of which are selectively adjustable by the user to accomplish bullet strike as nearly as possible to a point of aim. Firearms, particularly rifles, have for a considerable period of time been provided with mechanical sights, typically referred to as "iron sights", and with additional sighting devices, such as telescopes and other optical sighting devices. At times, if the mechanical sighting device cannot be readily used with an optical sighting device in place, it is desirable to remove the optical sighting device from the firearm. Typically, removal of an optical sighting device from a firearm requires the use of certain tools and equipment and the risk of losing sight mounting or adjusting parts if such an activity is carried out in a field environment. Moreover, removal of a sighting device from a firearm inevitably results in the loss of calibration, thus requiring the firearm to be again sighted in after the sighting device has been re-installed on the firearm. For these reasons, telescope sighting devices and sight mounts have been developed to permit hinged or pivotal movement of a telescope from an operative sighting position to a laterally off-set inoperative position. These improvements enable a telescope to be swung to and from a sighting position on a firearm without requiring re-adjustment of the sight.

More recently, especially in the tactical firearm environment various firearm sighting devices are often mounted on firearms in tandem so that the cumulative benefit of dual sighting devices enhances the character of firearm use. For example, an optical sighting device and a thermal or night vision sighting device can be used in tandem to provide the user with the capability for using optical sighting during conditions of poor light. Laser sighting devices are used in conjunction with telescope sights to provide the user with the benefits of a magnified image of a target and with laser sighting of the target. At times it is beneficial to eliminate a sighting device from the line of sight, but to do so ordinarily requires the use of tools or other equipment. In the tactical environment, military or law enforcement personnel do not ordinarily have sufficient available time for sight removal or installation, so the need for changes of sighting devices has largely remained unsatisfied.

Even more recently tactical personnel have been provided with the capability for efficient release and removal of an optical sighting device from a firearm having a mounting rail and re-installing the sighting device precisely to its previous calibrated condition.

There is a current need, especially in the field of tactical firearms, to provide a mounting device for optical sighting devices and other sight related devices that have a pivotal capability for movement of sighting devices between operative and inoperative positions without requiring the use of tools or equipment of any nature. Especially in the tactical environment it is desirable to provide a pivotal optical sight mount that secures an optical sight device against inadvertent movement even when the sighting device has been moved to its inoperative position. It is also desirable to provide a pivot mount that can be easily and quickly removed from a firearm together with its accessory, transported to a site for use, and then re-installed on the firearm in sight calibrated condition, so that the firearm can be used immediately for precision firing.

SUMMARY OF THE INVENTION

The subject matter of this application may involve, in some cases, interrelated products, alternative solutions to a particular problem, and/or a plurality of different uses of a single system or article.

In one aspect, a pivoting accessory mount for use with a firearm is provided. The pivoting mount comprises a base and a top, the top being pivotally attached to the base. The top is pivotally movable between an engaged position and a disengaged position. The top is further capable of limited linear movement relative to a length of the base. A protrusion extends from a side of the base. This protrusion is configured to be engaged with locking structures on a first side of the top. The locking structures, when engaged with the protrusion, hold the top in either an engaged or disengaged position.

In another aspect, a pivoting accessory mount for use with a firearm is provided. The pivoting mount comprises a base and a top, the top being pivotally attached to the base. The top is pivotally movable between an engaged position and a disengaged position via a shaft extending through an aperture of the base. The shaft ends extend from opposite edges of the base. The top is attachable to the shaft ends by openings on either side which are sized to receive the shaft. The top is further capable of limited linear movement along a length of the base by the openings on either side of the top being capable of sliding along the shaft. A protrusion extends from a side of the base. This protrusion is configured to be engaged with locking structures on a first side of the top. The locking structures of the top, when engaged with the protrusion, hold the top in either an engaged or disengaged position. A spring is positioned along the connection between the top and the shaft. This spring urges a second side of the top away from the base, so that the locking structures of the first side may be engaged with the protrusion.

DETAILED DESCRIPTION

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns pivoting mount for a firearm. In particular, the present invention provides an accessory mounting system that allows easy engagement and disengagement of various accessory devices in a rapid manner that further eliminates the need for realigning the accessory after each deployment. The pivoting mount has a base configured to be attached to the firearm, and a top portion pivotally attached to the base. The top portion is configured to receive a firearm accessory, and is capable of being pivoted between an engaged position and a disengaged position. The top is also capable of linear movement along a length of the base.

Figure 1:
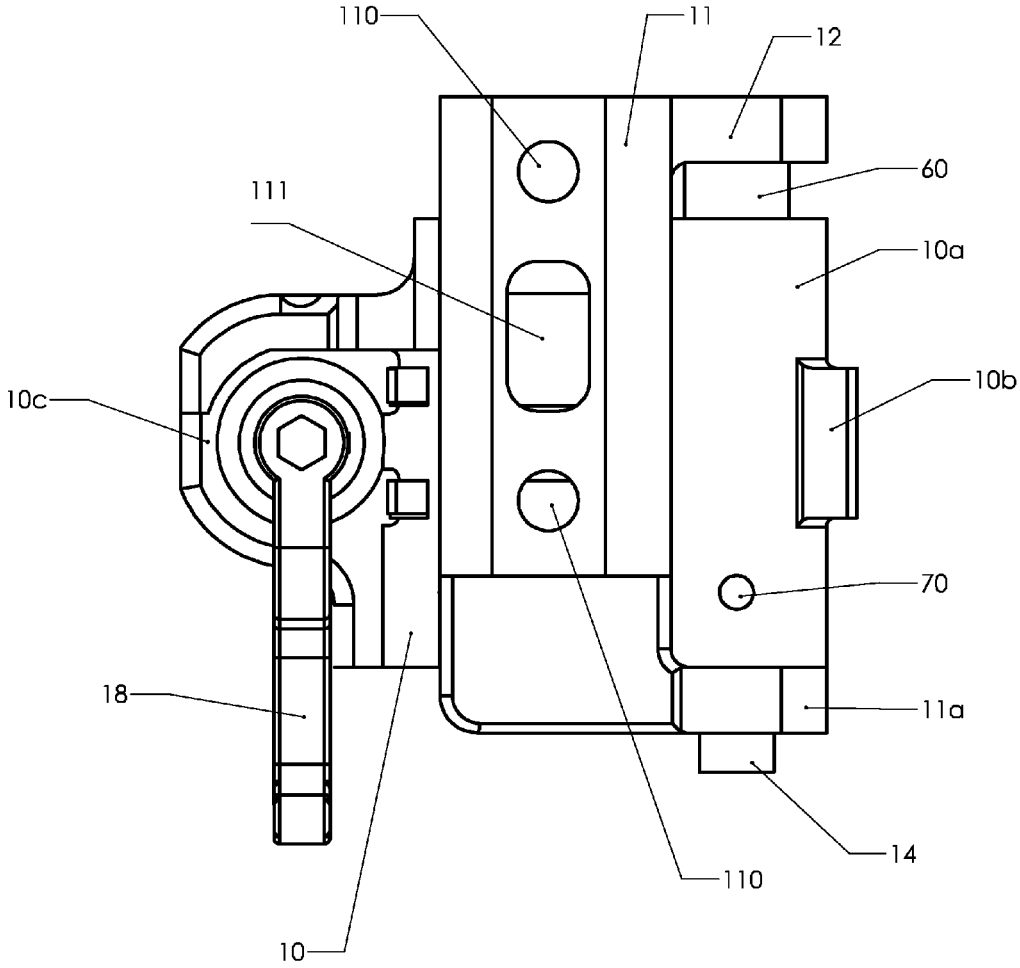
FIG. 1 provides a top view of an embodiment of the pivoting mount.
Figure 1A:
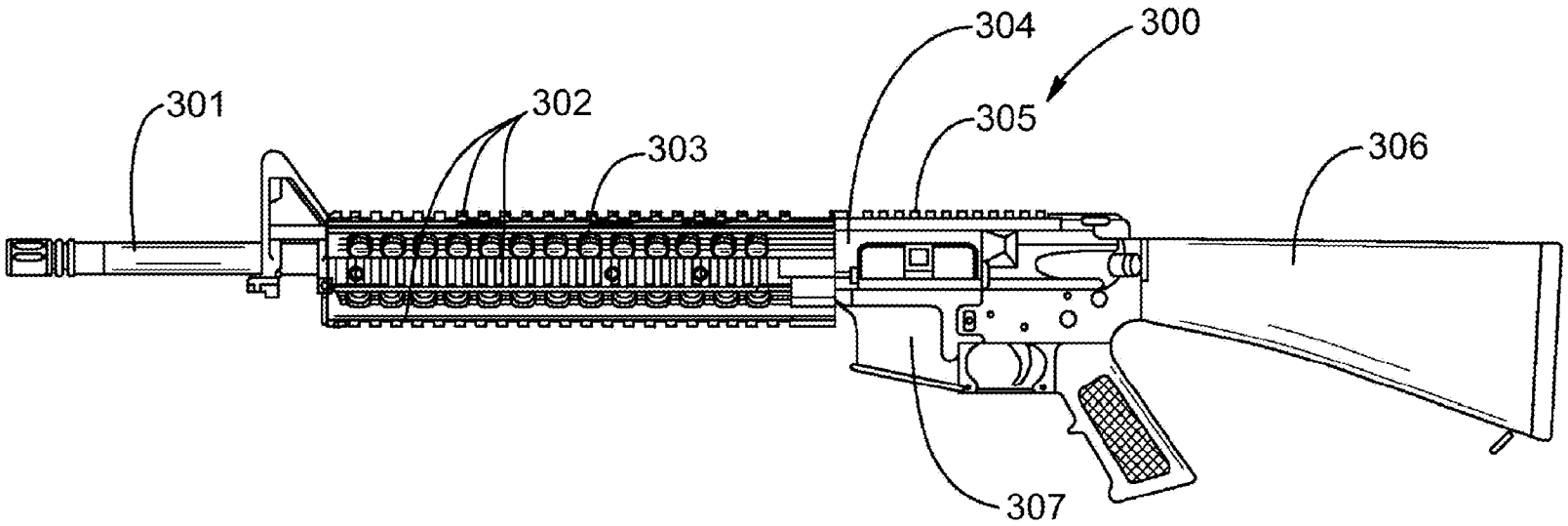
FIG. 1A provides a view of a typical military combat firearm.

For the purpose of illustration, a typical military combat firearm 300 is depicted in FIG. 1A. A conventional combat firearm 300 generally includes a conventional stock 306, an upper receiver 304 with a flattop 305, a lower receiver 307 and a barrel 301. The barrel 301 is joined to the upper receiver 304. The barrel 301 defines the forward portion of the firearm 300 and the stock 306 defines the rearward portion of the firearm. An accessory rail 302 is installed to the receiver 304 over the barrel 301. Further an accessory rail assembly 303 is shown installed in front of the upper receiver 304 and around the barrel 301.

Generally, the axis around which the top pivots is aligned with and parallel to the longitudinal axis of the firearm 300. Additionally, the top is configured such that when positioned in the engaged position, an accessory is in a position positioned above the rail 302 of the firearm. The disengaged position allows the top to pivot to one side (preferably the side opposite the shell discharge port) thereby positioning the top out of line of sight along the top of the firearm 300. This allows a clear line of sight for a user who desires to use the open sights of the firearm 300 or a primary sighting device, should the pivoting mount be holding a secondary sighting device.

Now referring to the figures, the pivoting mount is shown in varying embodiments. The pivoting mount may be attached to any firearm, particularly any firearm having an accessory rail 302. Firearm accessories that may be attached to the pivoting mount include, but are not limited to: sights, scopes, flash lights, lasers, range finders, infrared emitters, cameras, and the like. In this regard, the present invention provides a unique mount allowing these firearm accessories to be positioned in line with the barrel of the firearm, or pivoted to an offset position.

The pivoting mount may be formed of any material capable of attaching to a firearm and supporting an accessory. For example, materials of which the pivoting mount may be made include, but are not limited to: plastics, metals, composites such as carbon fiber, and the like.

Figure 7:
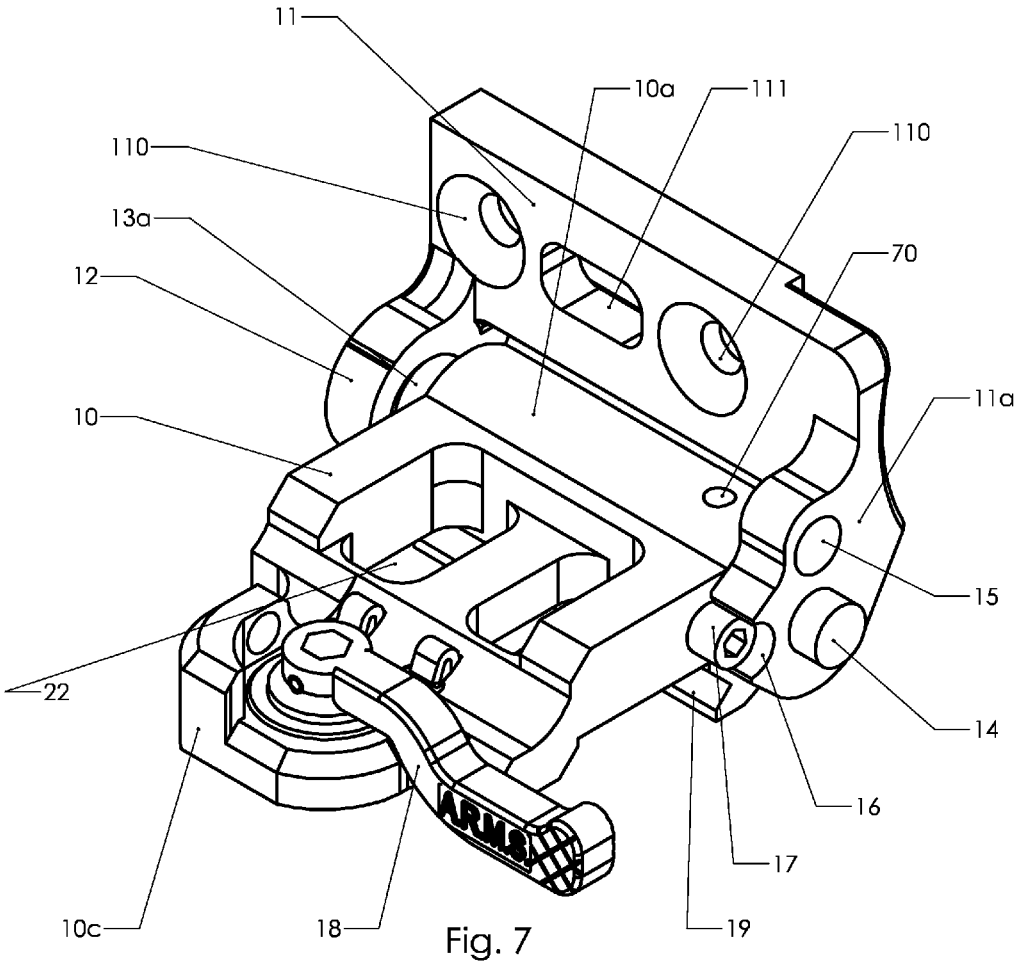
FIG. 7 provides a rear perspective view an embodiment of the pivoting mount.
Figure 8:
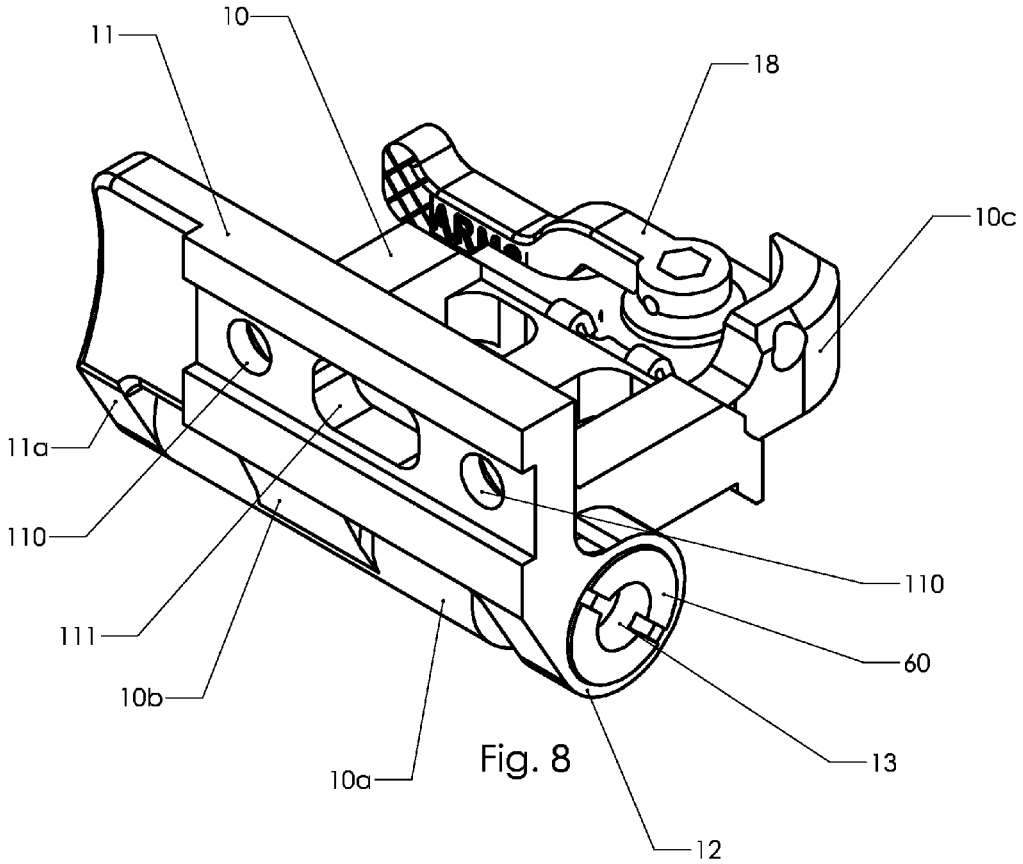
FIG. 8 provides a front perspective view an embodiment of the pivoting mount.

FIGS. 7 and 8 provide perspective views of an embodiment of the pivoting mount in a disengaged position. The base 10 has the top portion 11 mounted to it at a top receiving section 10*a*. The top 11 is mounted to the base such that it is capable of both rotational and linear movement. The base 10 has a number of portions, including the top receiving section 10*a*, a clamp section 10*c* and a pivot stopper 10*b*. The top receiving section 10*a* is configured to receive the top 11 in pivoting attachment. The clamp section 10*c* facilitates action of a swing arm 18 which moves from an open to engaged position, locking the base 10 to the firearm in an engaged position, and releasing the base 10 from the firearm in a disengaged position. The base 10 forms apertures 22 through its surface. These apertures are sized and configured to mate with protrusions from the firearm, such as protrusions on a standard rifle accessory rail 302. The base 10 also forms clamping region 19. Clamping region 19 is configured to hook around the rifle accessory rail 302. Once the base 10 is in position, the swing arm 18 may be moved to an engaged position, locking the base to the rail 302.

The top 11 has a first side 11*a* that attaches to the base and forms the locking structure to hold the top 11 in the disengaged position and engaged position and a second side 12 that attaches to the base 10. The top 11 is configured and structured to receive a firearm accessory. In this embodiment, the top 11 is configured with apertures 110, and 111 which facilitate attachment of the firearm accessory.

The second side 12 of the top 11 is configured to pivotally receive a shaft 13. A spring (not shown) is in communication with the top 11, either on the second side 12 or first side 11*a*. The top 11 is linearly displaceable along the shaft 13 and limited in this displacement by the second side 12 and first side 11*a* of the shaft and the top receiving section 10*a* of the base 10. The spring is disposed to urge the first side 11*a* against a side of the base 10, thereby engaging locking structures of the first side 11*a*. Linear movement of the top 11 is caused by application of manual force against the force of the spring.

In some embodiments, a spring retainer 60 may be attached to the second side 12. This spring retainer 60 may be hollow, and allow the shaft 13 to pass through. In this embodiment, a spring (not shown) may be in communication with the spring retainer 60. This spring is disposed to urge the second side 12 of the top 11 away from the base, thereby engaging the locking structure formed by the first side 11*a*.

The first side 11*a* of the top 11 forms locking structures 15, 16, that engage a protrusion 17, holding the top in either the disengaged position or the engaged position. These locking structures may be formed in any way capable of receiving the protrusion 17. For example, the locking structure may be formed as an aperture defined by the first side 11*a* such as locking structure 15, or a detent such as structure 16. In alternative embodiments, recessions may form both locking structures, or apertures may form both locking structures. It should be understood that other similar locking structures capable of receiving the protrusion are also within the scope of the contemplated invention.

Further, the first side 11*a* forms an aperture through which shaft 14 protrudes. Shaft 14 is rotatable within the aperture, and remains stationary when the top 11 is pivoted. Shaft 14 may pass through the top receiving section 10*a* and be a single piece with shaft 13. Alternatively, shaft 14 may be a protrusion from a face of the top receiving section 10*a*. Alternatively still, the shaft 14 may extend partially into the top receiving section 10*a*, but not all the way through to join to shaft 13. In the particular embodiment shown, the shaft 14 extends at least partially into the top receiving section 10*a* and is held in place by a screw 70.

In an alternative embodiment, the shaft may be replaced by projections extending inwardly from the top, these projections may mate with slot openings defined by the base 10 at, for example, the top receiving section 10*a*. In this embodiment, the projections may be rotatable within the slots, and allow the top to pivot similarly to how it would pivot with the shaft structure. As such, the projections may replace a shaft in this embodiment.

FIGS. 1-6 provide various views of another embodiment of the pivoting mount. The pivot mount shown here has the top 11 in an engaged position, partially covering the base 10. In operation, the engaged position would position an accessory (not shown) in line with the firearm barrel 301. The second side 12 and first side 11*a* of the top 11 are attached to the base 10 by spring retainer 60 and shaft 14. The shafts 13,14 and spring retainer 60 are attached to the top receiving section 10*a* of the base 10. Further, the base 10 forms a protruding pivot stopper 10*b* which prevents over-rotation of the top 11 when moving to the disengaged position. Apertures 110 and 111 allow attachment of the firearm accessory to the top 11. The clamp section 10*c* facilitates action of the swing arm 18 which moves from an open to engaged position, locking the base 10 to the firearm 300 in the engaged position, and releasing the base 10 from the firearm in a disengaged position.

In one embodiment, the swing arm 18 may be in communication with a locking structure such as that taught in U.S. Pat. No. 5,276,988, incorporated herein by reference. However, it should be understood that any locking structure capable of attaching the pivot mount to a firearm is sufficient. Further, a swing arm 18 may be replaced with another structure capable of locking and releasing the base to the firearm, such as a ratcheting mechanism, a snap connection, and the like.

Figure 2:
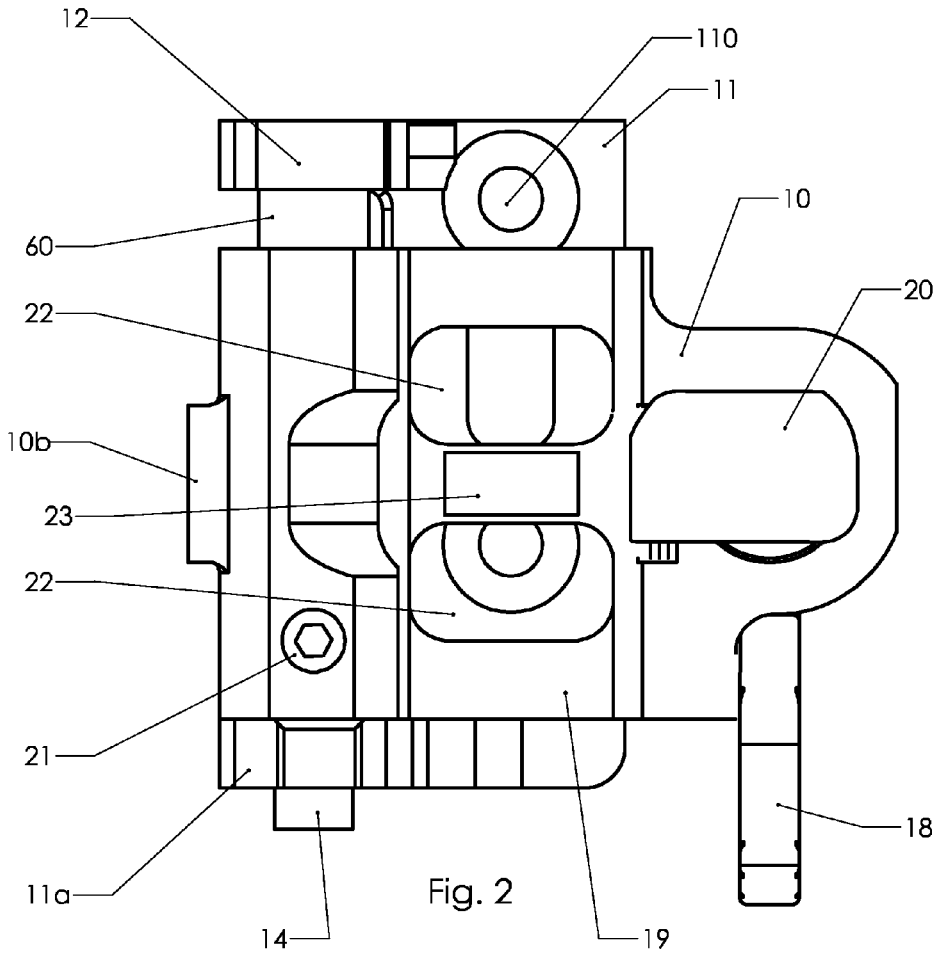
FIG. 2 provides a bottom view of an embodiment of the pivoting mount.
Figure 3:
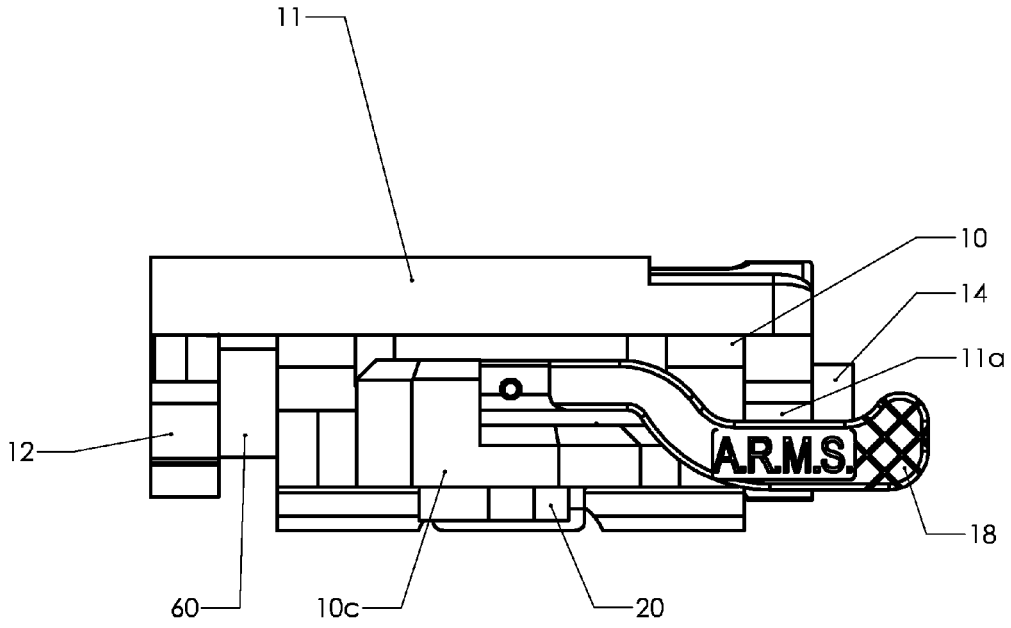
FIG. 3 provides a rear view of an embodiment of the pivoting mount.
Figure 4:
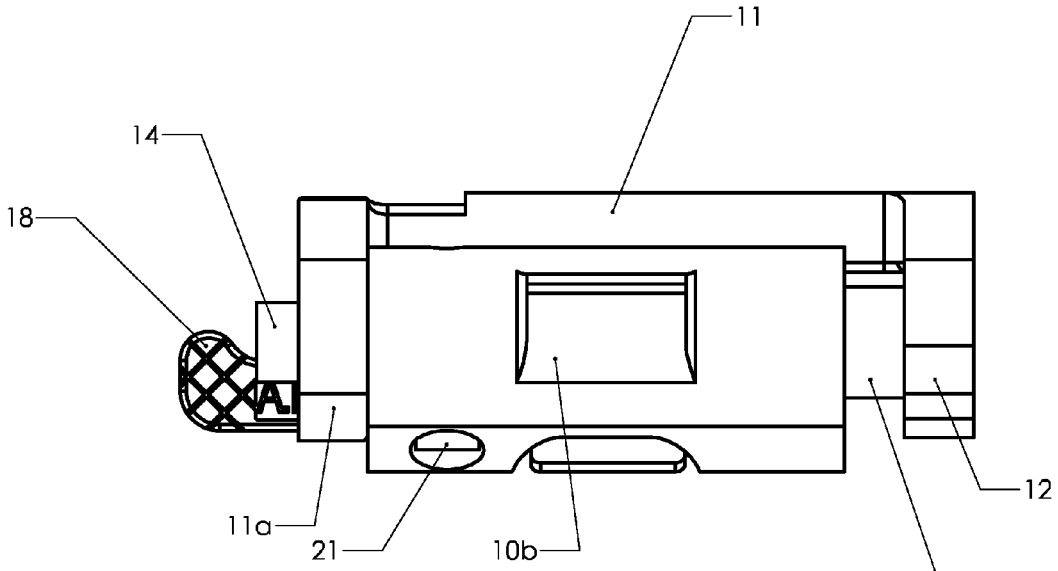
FIG. 4 provides a front view of an embodiment of the pivoting mount.
Figure 5:
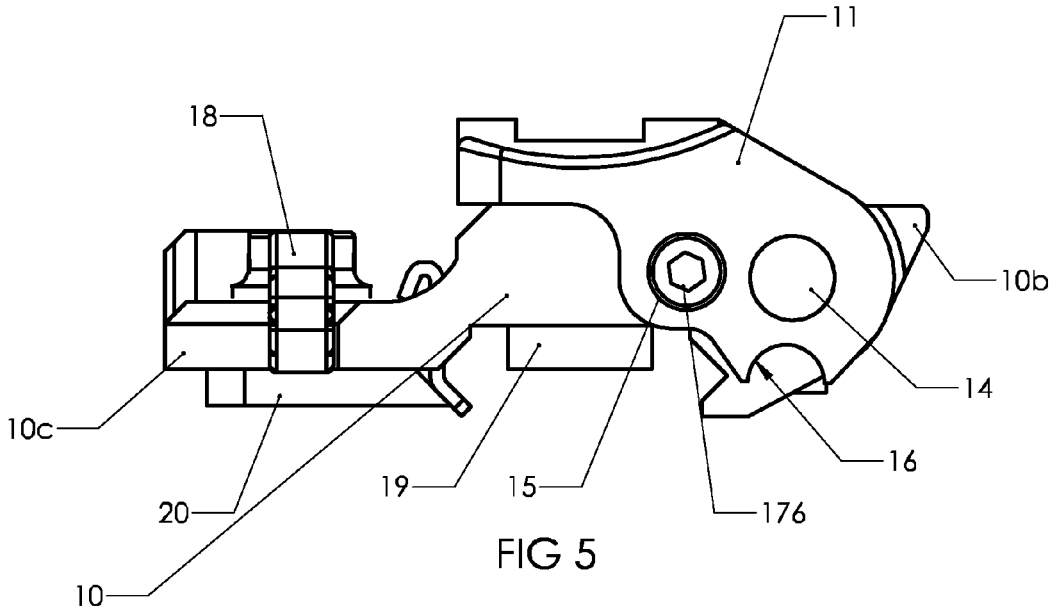
FIG. 5 provides a side view of an embodiment of the pivoting mount.
Figure 6:
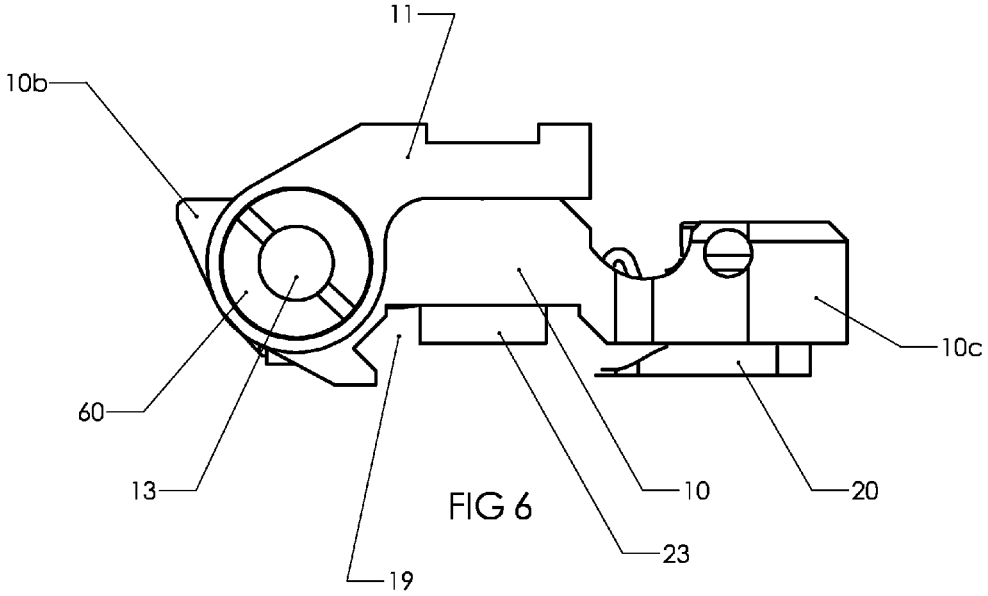
FIG. 6 provides a side view of an embodiment of the pivoting mount.

As seen in FIG. 2, the bottom of the pivoting mount comprises apertures 22 and a protrusion 23 to secure to a mounting rail 302 of a firearm. Further, plate 20 is attached to swing arm 18 by a shaft (not shown) passing through the clamp section 10*c* of the base 10. The shape of the plate 20 is such that when the swing arm 18 is in an engaged position, an edge of the plate 20 extends over the clamping region 19 formed by the base 10. As such, the plate 20 clamps the base 10 onto a rail 302 of the firearm. A screw 21 is used in this embodiment to secure the shaft 14 to the top receiving section 10*a* of the base 10.

Figure 9:
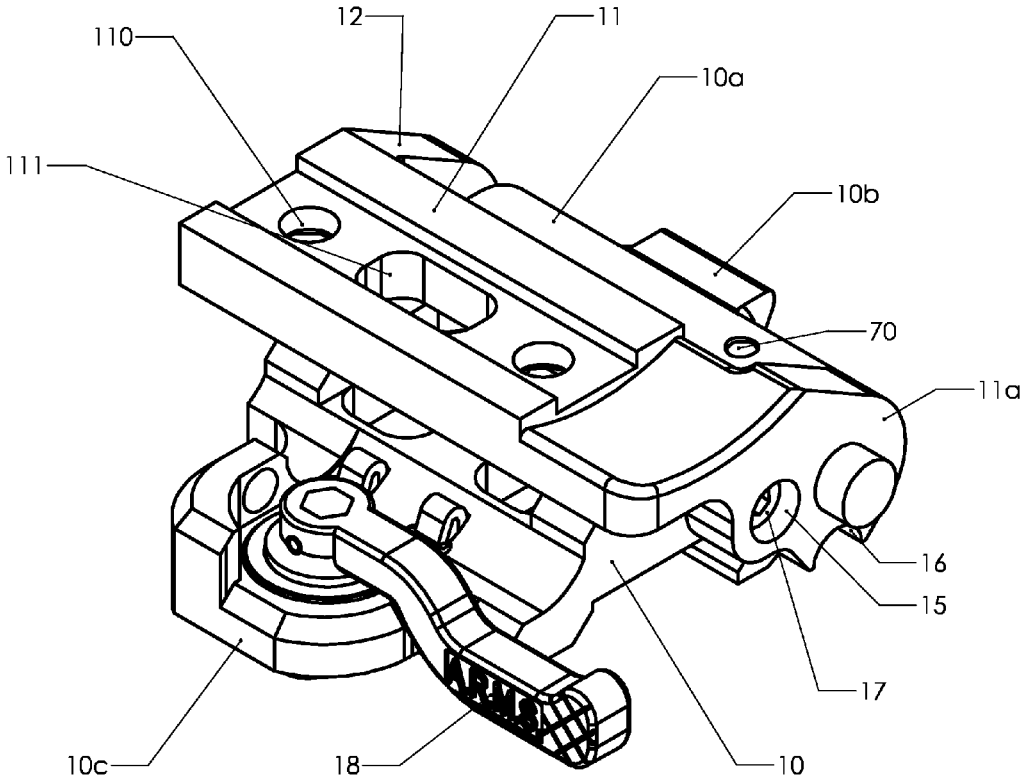
FIG. 9 provides a rear perspective view an embodiment of the pivoting mount.
Figure 10:
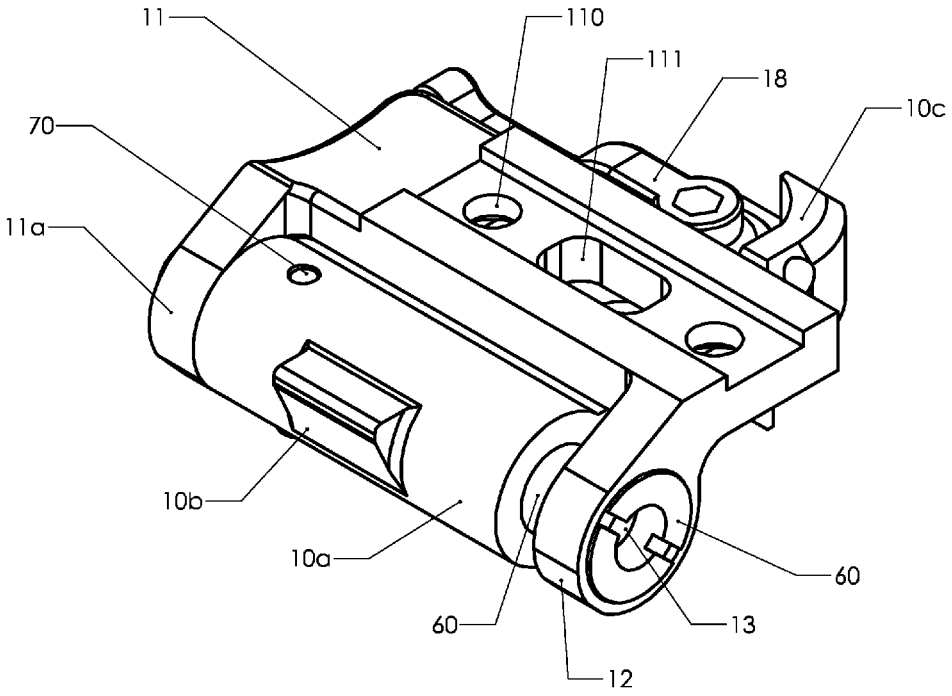
FIG. 10 provides a front perspective view an embodiment of the pivoting mount.
Figure 12:
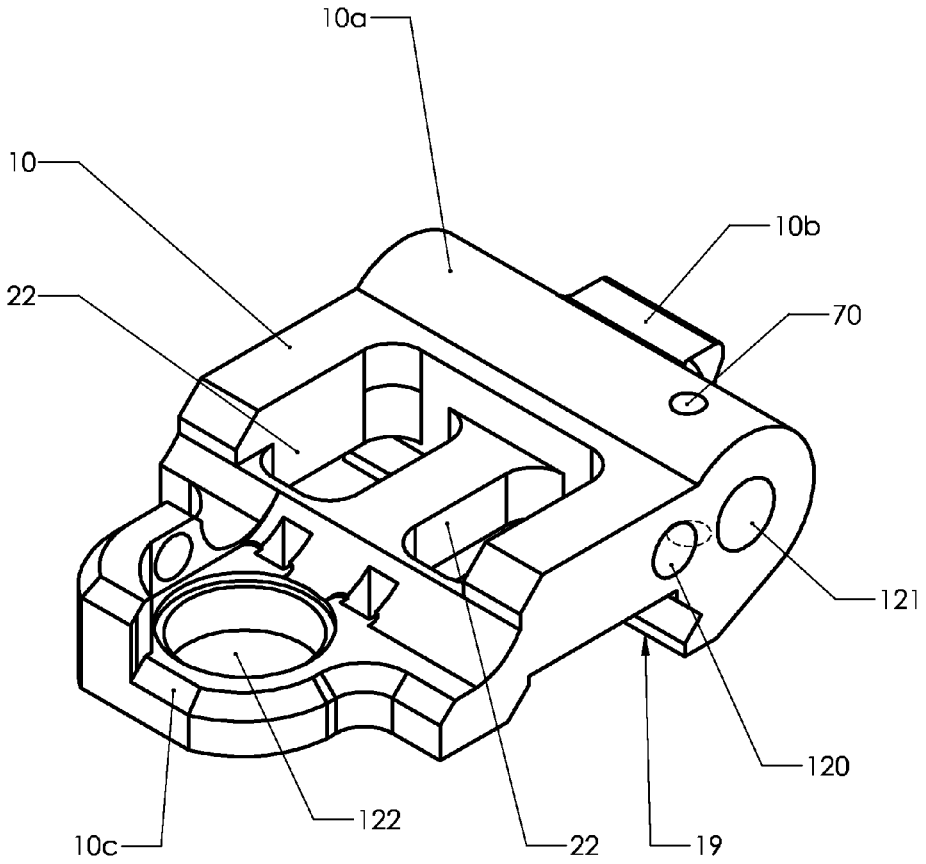
FIG. 12 provides a perspective view an embodiment a base of the pivoting mount.
Figure 13:
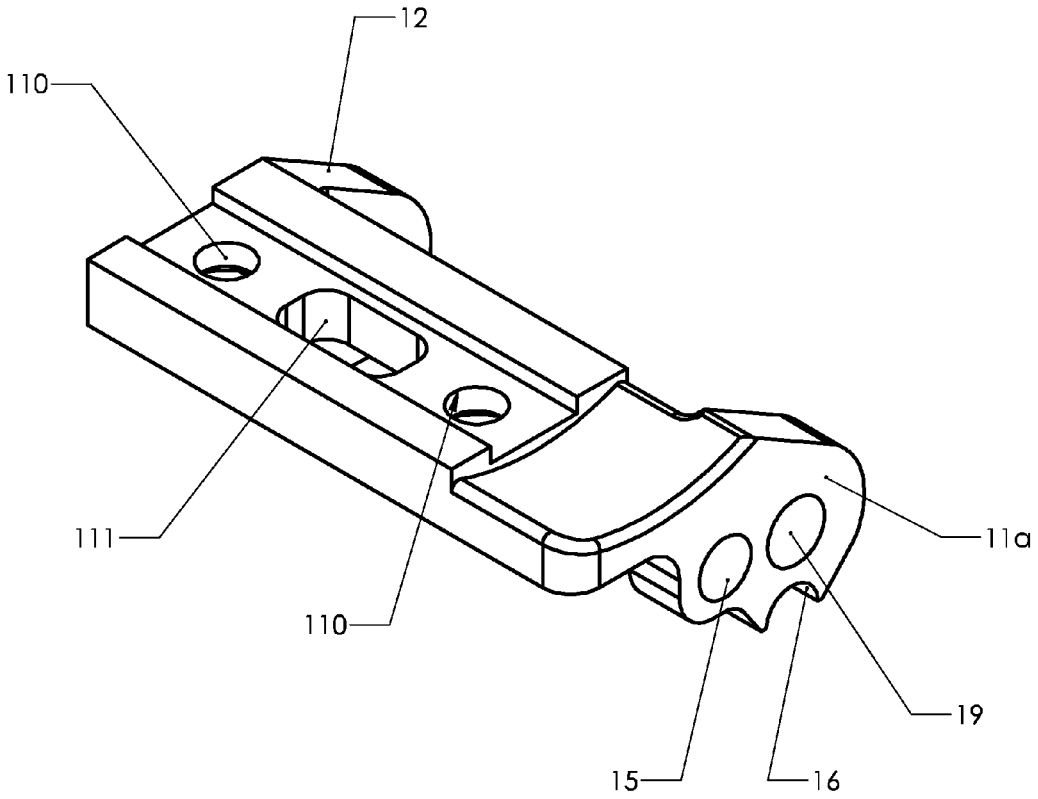
FIG. 13 provides a perspective view an embodiment a top of the pivoting mount.
Figure 14:
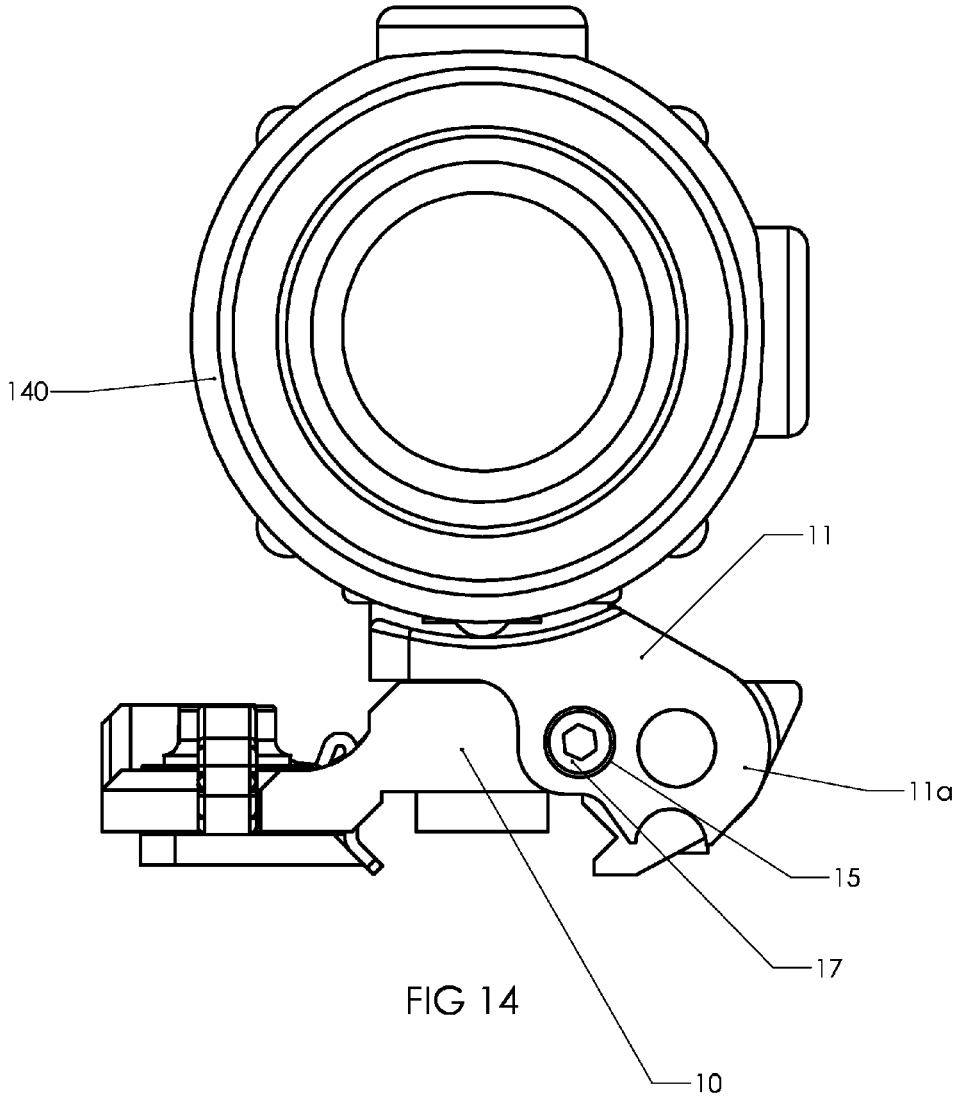
FIG. 14 provides a side view of an embodiment of the pivoting mount.
Figure 15:
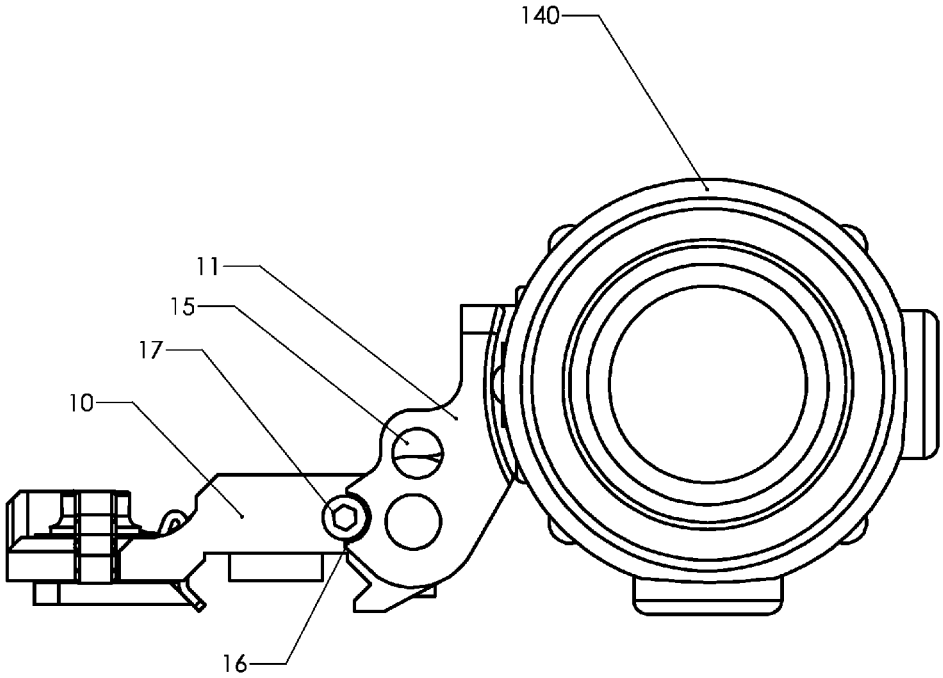
FIG. 15 provides a side view of an embodiment of the pivoting mount.
Figure 16:
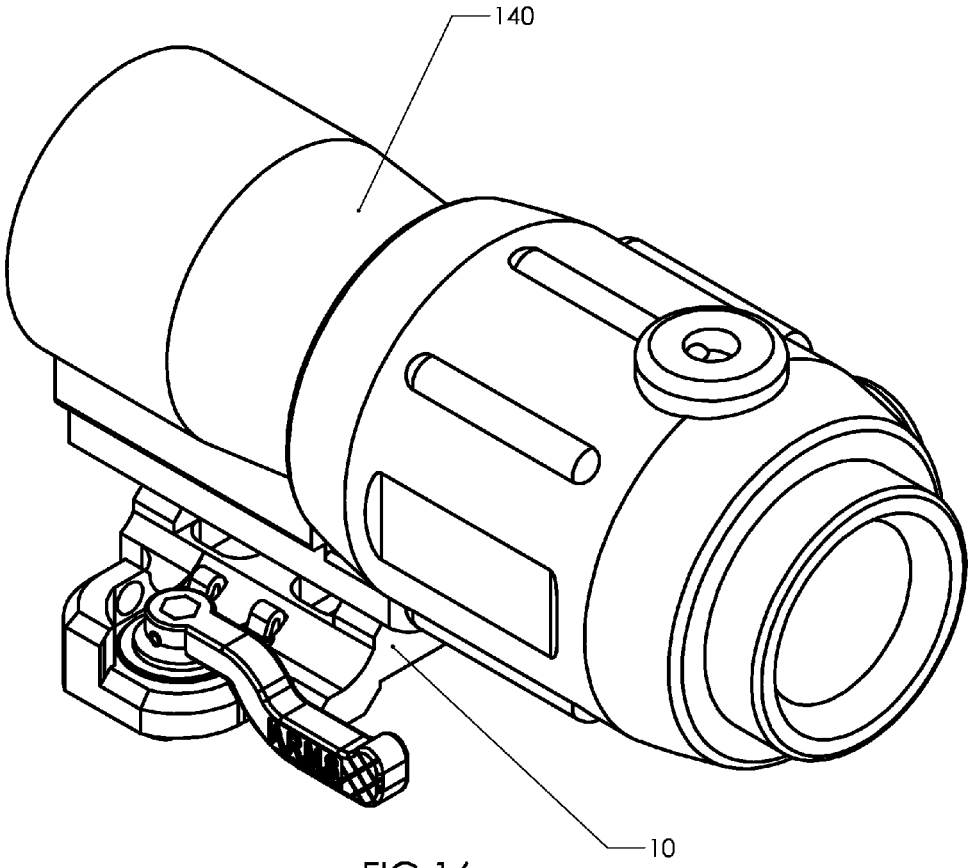
FIG. 16 provides a perspective view of an embodiment of the pivoting mount.
Figure 17:
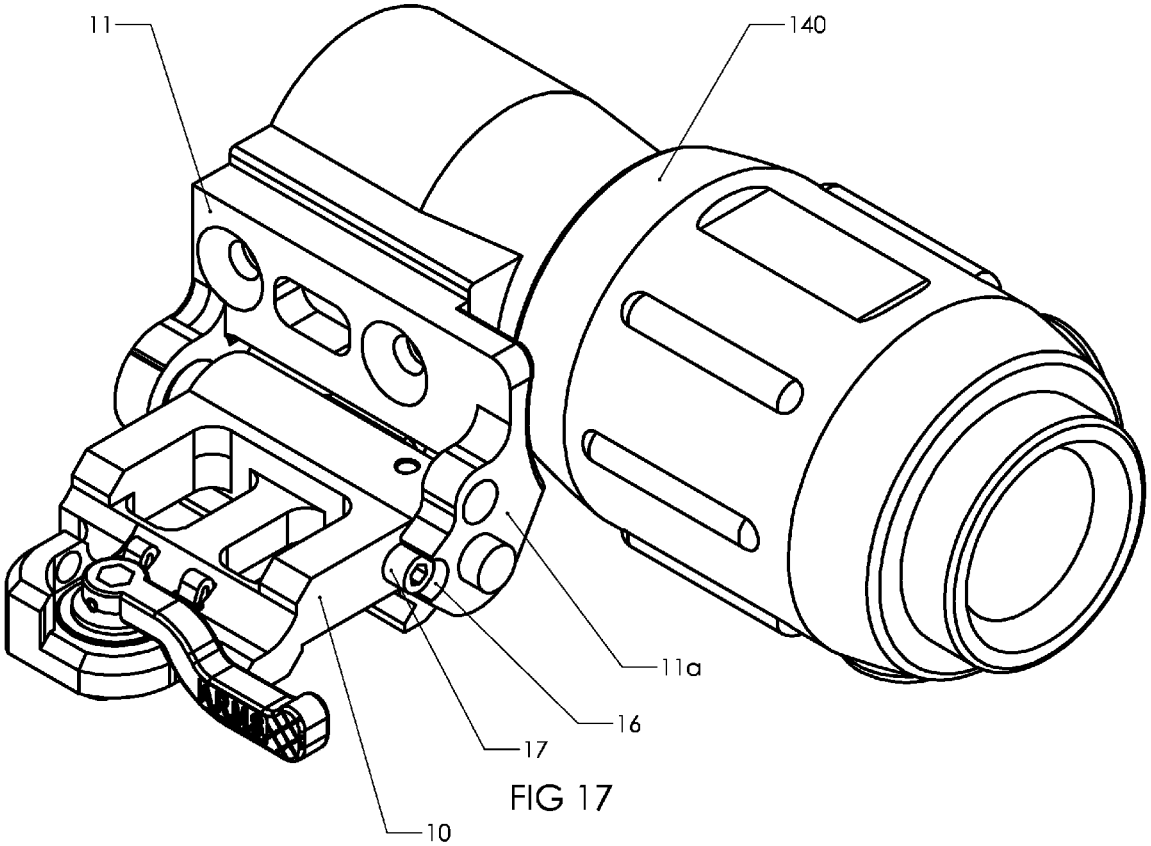
FIG. 17 provides a perspective view of an embodiment of the pivoting mount.
Figure 18:
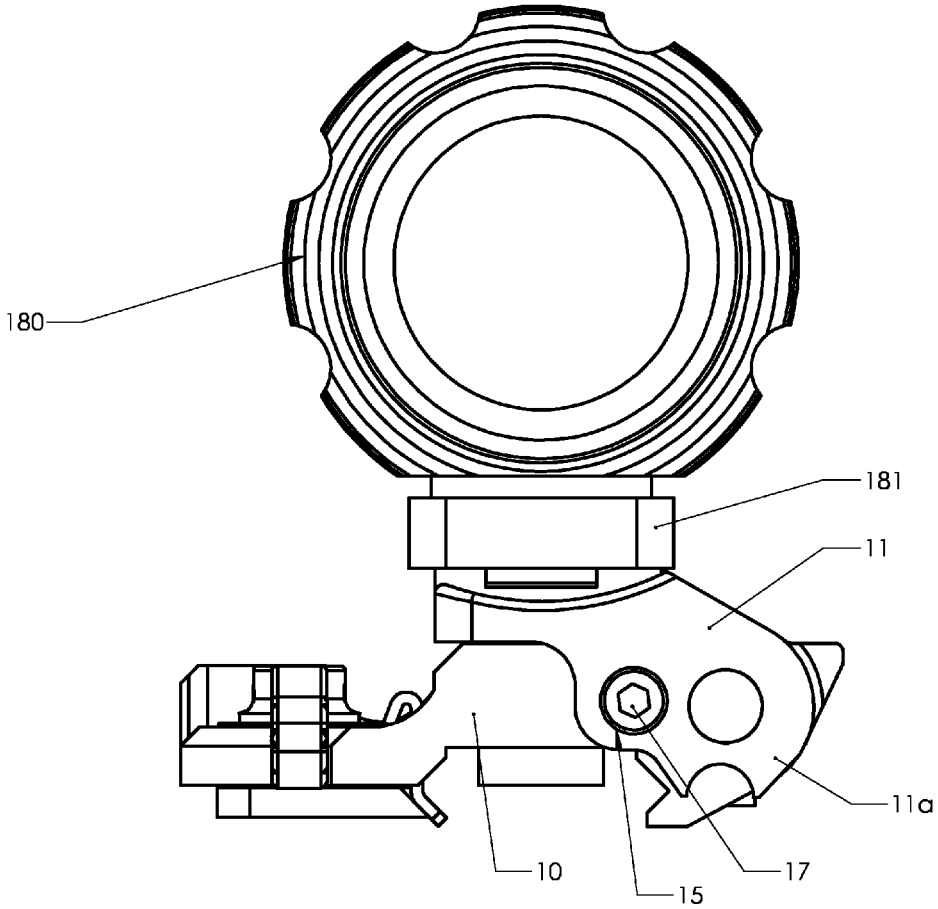
FIG. 18 provides a side view of an embodiment of the pivoting mount.
Figure 19:
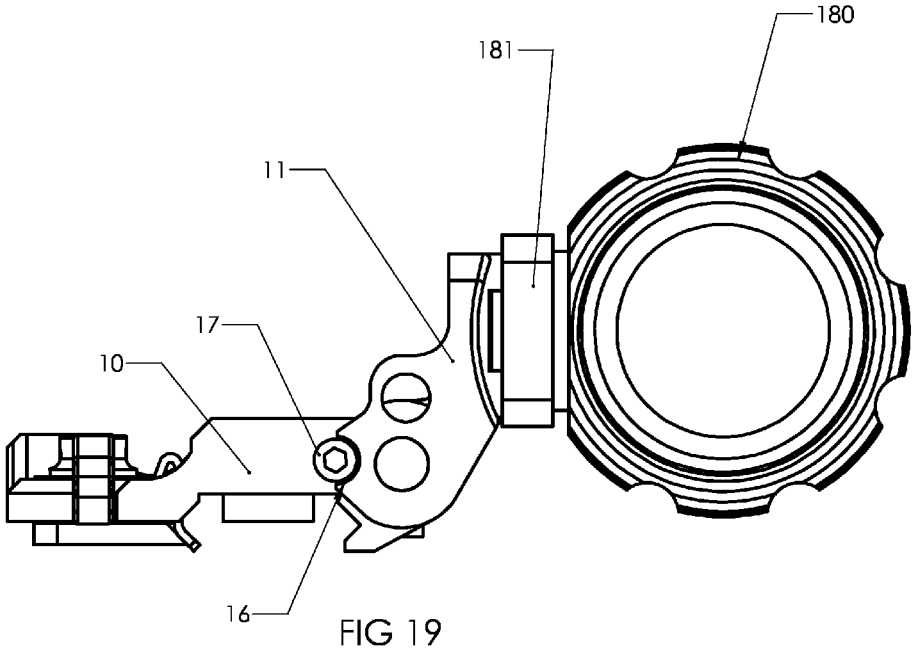
FIG. 19 provides a side view of an embodiment of the pivoting mount.
Figure 20:
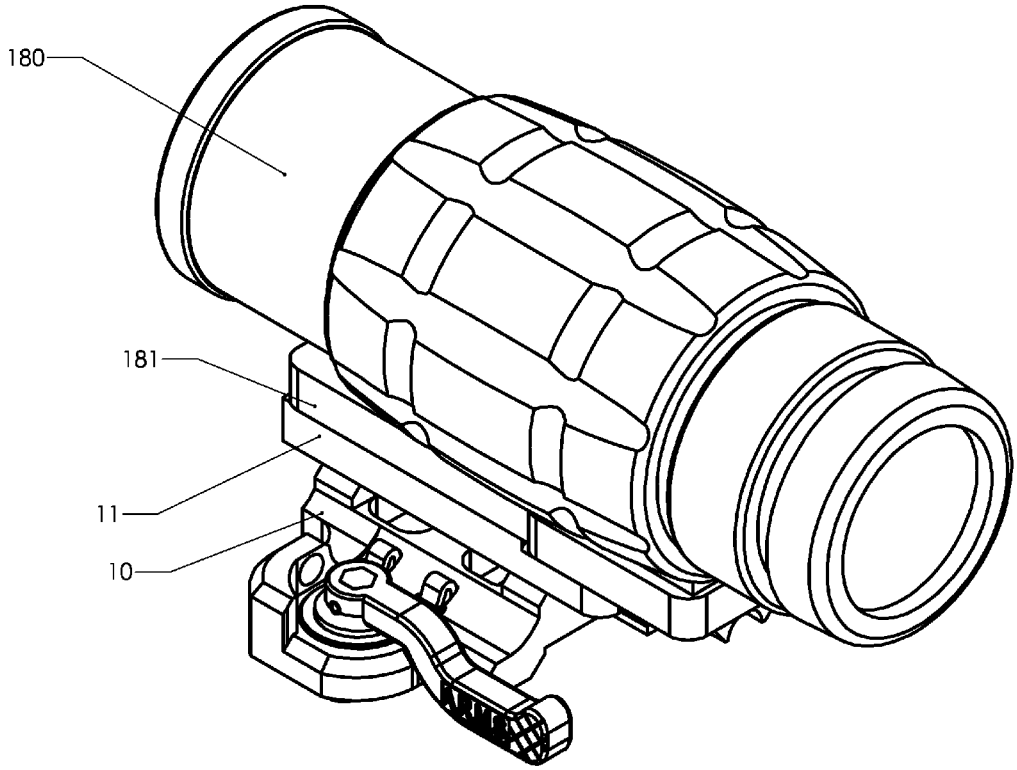
FIG. 20 provides a perspective view of an embodiment of the pivoting mount.

FIGS. 9 and 10 provide front and rear perspective views of the pivoting mount 1 in the engaged position. As noted above, the engaged position is the position of the pivoting mount 1 when an accessory would be in-line with a barrel 301 of the firearm. Moreover, FIGS. 12 and 13 provide individual component views of the base 10 and top 11, respectively.

Figure 11:
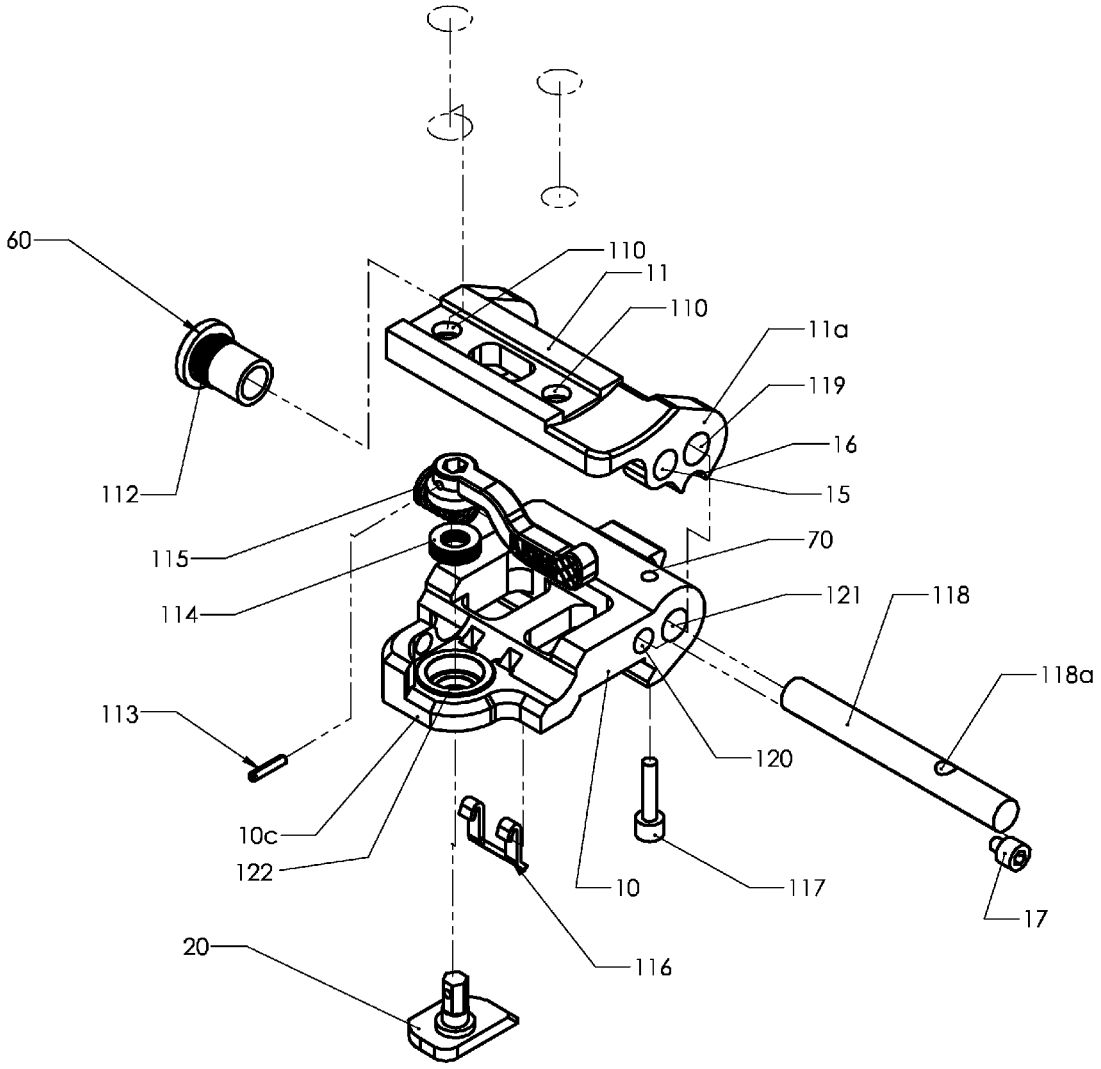
FIG. 11 provides an exploded view an embodiment of the pivoting mount.

FIG. 11 provides an exploded view of an embodiment of the pivoting mount 1. The top 11 is shown positioned over the base 10 but not connected to it. A shaft 118 is positionable within an aperture 121 defined by the top receiving section 10*a*. The shaft 118 is sized such that its ends protrude from both sides of the top receiving section 10*a*, allowing the top 11 to be connected to the base 10 by the shaft 118 at both its ends. The shaft 118 defines an transverse bore 118*a* through its center. A screw 117 passes through this bore 118*a* when the shaft 118 is positioned properly within the aperture 121 defined by the base 10. The screw 117, when properly positioned, ensures that the shaft 118 remain in place.

The top 11 defines a socket 119 through which a protruding end of the shaft 118 can be rotatably received. Similarly, in this embodiment, spring retainer 60 forms a hollow section sized to receive a second protruding end of the shaft 118 on the opposite side of the base. The spring retainer 60 attaches to the second side 12 of the top (not shown). Threads 112 are formed on an end of the spring retainer 60 which allow it to be securely attached to the second side 12 of the top 11.

A spring 115 is positioned either over an outer face of the spring retainer 60, or in line with its leading edge. When the parts are attached in position, the spring 112 abuts a face (not shown) defined by the base 10. This spring 112 urges the second side 12 of the top 11 away from the base 10, thereby urging the first side 11*a* towards the base 10. In an alternative embodiment, the spring 112 may be biased to pull a side of the top 11 towards the protrusion 17. In this embodiment, the spring 112 would be positioned on the same side of the base 10 as the protrusion, and be attached to the first side 11*a* of the top 11.

The base 10 further defines a socket 120 for attachment of a protrusion 17. The protrusion 17 is shown here as a removable screw with a substantial head. In alternative embodiments, the protrusion 17 may be a pin, an integral protrusion extending from the base, and the like. As noted, the protrusion 17 is sized and configured to mate with the locking structures 15, 16 to hold the top in either the engaged or disengaged position.

FIG. 11 further provides an exploded view of the clamp section 10*c* and components. In this embodiment, the swing arm 18 connects to a ratchet device 114 which is seated in the clamp section 10*c*. The plate 20 comprises a shaft which extends through a passage 122 of the clamp section 10*c* and attaches to the swing arm 18. A pin 113 connects the swing arm 18 and plate 20 together. A clamp 116 attached to the base 10 may be utilized to aid in the clamping of the pivot mount to the firearm rail 302. The clamp 116 is specifically shaped to clamp around a surface of the firearm rail 302, and is configured to be urged into position by the plate 20.

FIGS. 14 through 17 provide views of the pivot mount 1 having an accessory 140 attached to the top 11. These figures show the pivot mount with the accessory attached in both an engaged and disengaged position. In this embodiment, the accessory 140 is a firearm sight.

FIGS. 18 through 21 provide views of the pivot mount 1 having an accessory 180 attached to the top 11. A spacer 181 is used to facilitate attachment of the accessory 180 to the top 11. The spacer 181 may be used to attach an accessory 180 to the top 11 if the attachment configuration of the accessory 180 does not match that of the top 11, or to properly position the accessory 180, or both. These figures show the pivot mount with the accessory attached in both an engaged and disengaged position. In this embodiment, the accessory 180 is a firearm sight.

Figure 21:
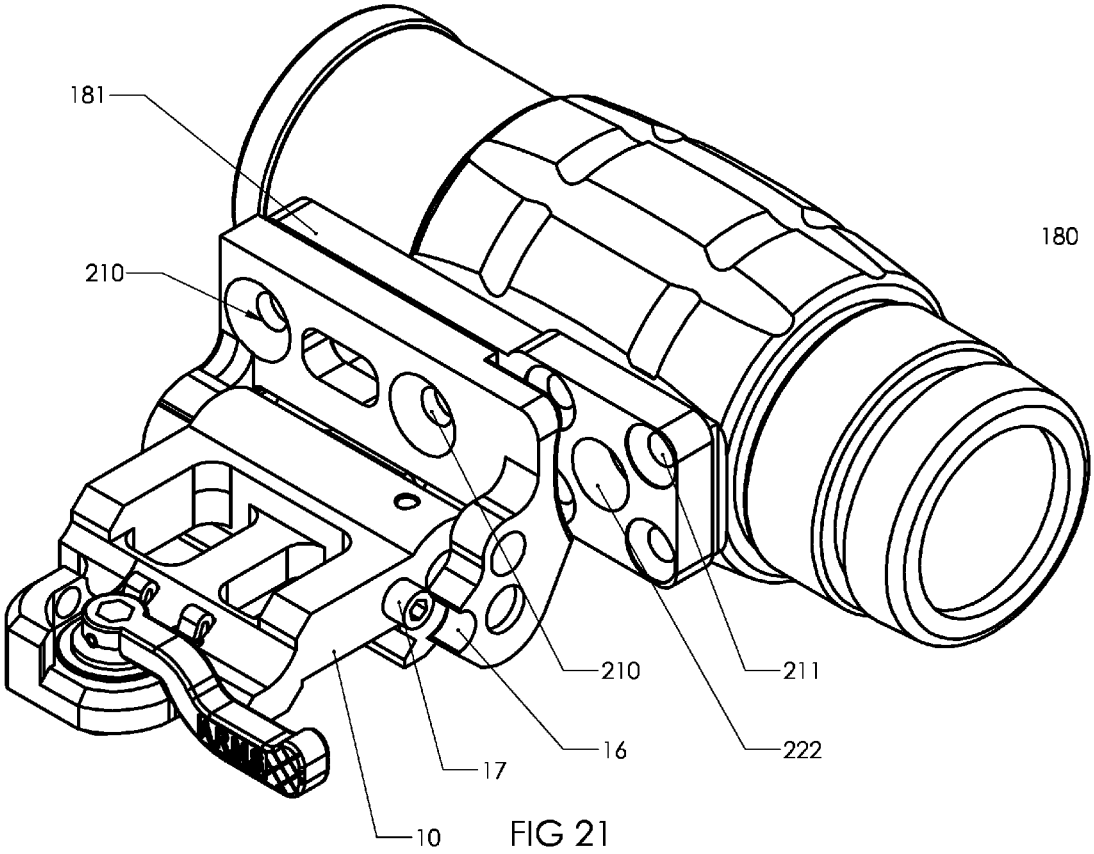
FIG. 21 provides a perspective view of an embodiment of the pivoting mount.

In particular, FIG. 21 shows a front perspective view of the pivoting mount in a disengaged position, such that the under-side of the spacer 181 may be seen. In this embodiment, the spacer forms attachment holes 211, 222 which are specifically configured to connect with an attaching structure of accessory 180. The spacer 181 is further configured to connect to the top 11 through attachment holes 210.

In operation, the pivoting mount may be attached to the firearm. Before or after attachment to the firearm, an accessory is mounted to the top 11 of the pivoting mount. When the top is in an engaged position, the accessory is in-line with a barrel of the firearm. For example, if the accessory is a scope, when the top is in an engaged position, the scope would be in use, allowing a user to look through the scope. If the scope was undesired in a particular situation, a user may draw the accessory (which is attached to the top) linearly in a direction to disengage the protrusion from the locking structure. Once disengaged the top may pivot freely, against the force exerted by the spring. The accessory may then be pivoted away from the engaged position to the disengaged position. Once the disengaged position is reached, the user may release the accessory, and the spring will draw the protrusion into the disengaged position locking structure. As such, the accessory will be out of the way of the firearm user. A similar action in reverse allows the top and accessory to move back to the engaged position.

It can therefore be seen that the present invention provides a reliable, easy to use pivoting mount for a firearm that allows a firearm accessory to be quickly and reliably pivoted between a disengaged position and an engaged position while eliminating the need for recalibration and alignment. The present invention can be modified to accommodate a number of different types of firearm accessories as well as being suited for mounting onto any type of known firearm configurations.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A pivoting accessory mount for use with a firearm comprising:

a base constructed and arranged to be received in a substantially fixed position on a firearm;

a top pivotally attached to the base, the top being further capable of linear movement along a length of the base, the top having a first side and second side which attach to the base;

a protrusion extending from a side of the base;

a spring positioned in communication with the top and in communication with the base, the spring urging the first side of the top linearly towards the base;

wherein the second side further comprises a spring retainer, the spring retainer configured to secure the spring in communication with the base; and wherein the first side of the top defines a first locking structure and a second locking structure, the first locking structure configured to engage the protrusion when the top is in an engaged position, and the second locking structure configured to engage the protrusion when the top is in a disengaged position, wherein the first or second locking structure is held engaged with the protrusion by the spring.

2. The pivoting accessory mount of claim 1 further comprising a shaft extending from the base, the shaft connecting the top to the base.

3. The pivoting accessory mount of claim 2 wherein the top first side forms an opening to receive the shaft, the top being rotatable and linearly movable about the shaft.

4. The pivoting accessory mount of claim 1 wherein the protrusion is a screw head.

5. The pivoting accessory mount of claim 1 wherein the protrusion is a pin.

6. The pivoting accessory mount of claim 1 wherein the top defines an accessory-receiving aperture.

7. The pivoting accessory mount of claim 1 wherein the base further comprises a clamp configured to be attached to an accessory rail of the firearm.

8. The pivoting accessory mount of claim 1 wherein the first locking structure is an aperture defined by the first side of the top.

9. The pivoting accessory mount of claim 1 wherein the first locking structure is a detent defined by the first side of the top.

10. A pivoting accessory mount for use with a firearm comprising:

a base constructed and arranged to be received in a substantially fixed position on a firearm;

a shaft disposed through an aperture formed by the base, a first end and second end of the shaft extending beyond a first and second edge of the base, the shaft being rotationally and linearly fixed to the base;

a top pivotally attached to the shaft, the top being further capable of linear movement along the protruding first and second ends of the shaft, the top having a first side forming an opening that receives the first end of the shaft, and a second side that forms a socket that receives the second end of the shaft;

a protrusion extending from the first edge of the base wherein the protrusion is formed as a screw head; and wherein the first side of the top defines a first locking structure and a second locking structure, the first locking structure configured to lock the top in an engaged position, and the second locking structure configured to lock the top in a disengaged position, the first and second locking structures configured to engage the protrusion.

11. The pivoting accessory mount of claim 10 further comprising a spring positioned along an attachment of the top to the base, the spring urging the first side of the top linearly towards the base; and wherein the first or second locking structure is held engaged with the protrusion by the spring.

12. The pivoting accessory mount of claim 10 wherein the base further comprises a clamp configured to be attached to an accessory rail of the firearm.

13. The pivoting accessory mount of claim 10 wherein the first locking structure is an aperture defined by the first side of the top.

14. The pivoting accessory mount of claim 10 wherein the first locking structure is a detent defined by the first side of the top.

15. A pivoting accessory mount for use with a firearm comprising:

a base constructed and arranged to be received in a substantially fixed position on a firearm, the base comprising a clamp configured to be attached to an accessory rail of the firearm, the clamp lockable about the accessory rail by a movement of a swing arm, the base further comprising an aperture to receive a protrusion of the accessory rail;

a shaft disposed through an aperture formed by the base, a first end and second end of the shaft extending beyond a first and second edge of the base, the shaft being rotationally and linearly fixed to the base;

a top pivotally attached to the shaft, the top being further capable of linear movement along the protruding first and second ends of the shaft, the top having a first side forming an opening that receives the first end of the shaft, and a second side that forms a socket that receives the second end of the shaft, the top further defining an aperture to receive an accessory;

a protrusion extending from the first edge of the base;

wherein the first side of the top defines a first locking structure and a second locking structure, the first locking structure formed as an aperture in the first side, and configured to lock the top in an engaged position, and the second locking structure formed as a detent in the first side, and configured to lock the top in a disengaged position, the first and second locking structures configured to engage the protrusion;

a spring positioned between the base and a spring retainer threadedly mounted to the second side of the top, the spring urging the second side of the top linearly away from the base, and holding the protrusion engaged with the first or second locking structure.

* * * * *